US005937556A

United States Patent [19]

Daily et al.

[11] Patent Number: 5,937,556

[45] Date of Patent: Aug. 17, 1999

[54] MECHANISM AND METHOD FOR FIRING CAPS

[76] Inventors: Timothy M. Daily, 7 Walt Ln., Wyncote, Pa. 19095; James R. Distel, 801 E. Abington Ave., Glenside, Pa. 19038

[21] Appl. No.: 09/024,310

[22] Filed: Feb. 17, 1998

[51] Int. Cl.[6] ..... A63H 5/00

[52] U.S. Cl. ..... 42/57; 42/1.11; 124/2; 36/139; 446/26

[58] Field of Search ..... 42/57, 1.11; 124/2; 36/139; 446/26; 89/37.04

[56] References Cited

U.S. PATENT DOCUMENTS

| | | | |
|---|---|---|---|
| 258,218 | 5/1882 | Cassidy | 36/139 |
| 1,872,093 | 8/1932 | Peake | 42/57 |
| 1,943,222 | 1/1934 | Landi | 36/139 |
| 2,478,567 | 8/1949 | Clark | 42/57 |
| 2,735,220 | 2/1956 | Miles | 36/139 |
| 2,877,689 | 3/1959 | Pribis | 89/37.04 |
| 3,501,144 | 3/1970 | Schmidt | 36/139 |
| 3,878,641 | 4/1975 | Noble | 36/139 |
| 4,513,519 | 4/1985 | Hedrick | 36/139 |

FOREIGN PATENT DOCUMENTS

| | | | |
|---|---|---|---|
| 623322 | 6/1927 | France | 42/57 |

*Primary Examiner*—Stephen M. Johnson
*Attorney, Agent, or Firm*—LaMorte & Associates

[57] ABSTRACT

A device and method for firing a cap contained within a row of caps. The device includes a base structure for retaining the row of caps so that one of the caps is set in a predetermined firing location. A hammer pin is provided that is movable with respect to the base structure and the cap held therein. The hammer pin is positioned adjacent to the cap in the predetermined firing position so that when the entire device is compressed the hammer pin strikes and fires the cap. The device is preferably compressed by locating the device either in or on the sole of a shoe. As a person stands on that shoe, the device will become compressed and the cap will fire. The device also preferably contains an advancement mechanism for automatically advancing a new cap into the firing position after a cap has been fired. In this manner, multiple caps can be fired simply by walking, running or jumping.

11 Claims, 4 Drawing Sheets

MECHANISM AND METHOD FOR FIRING CAPS

BACKGROUND OF THE INVENTION

1. Field of the Invention

The present invention relates in general to shoes having sound generating devices either attached to the shoe or designed into the structure of the shoe. The present invention also relates to cap triggering mechanisms that are used to explode toy caps of the type used in cap guns.

2. Description of the Prior Art

Toy caps contain small amounts of explosive powder sealed within a plastic housing or in between layers of paper. As the cap is struck, the explosive powder explodes making a loud popping sound. In the prior art record, there is a wide variety of different mechanisms used to fire toy caps. Typically, the mechanism used to fire the cap is a cap gun. Cap guns typically have a hammer mechanism controlled by the trigger of the gun. When the trigger is squeezed, the hammer falls against a cap, thereby causing the cap to fire. The firing of the cap therefore gives the toy gun a loud sound effect that enhances the toy's play value.

Toy caps are fired in a plurality of mechanisms other than cap guns. For example, there are toy rockets that hold caps in their noses. The rockets are thrown through the air, wherein the cap explodes when the rocket's nose strikes the ground. The key to the popularity of toy caps and toys that use toy caps is that children enjoy making loud noises using caps. This is evidenced by the fact that many children fire caps just by hitting them with rocks or heating them with a magnifying glass.

Another way that children like to make noise is by stomping their feet on surfaces, such as hard floors, that produce noise. However, since an appropriate flooring surface is not always available, different types of shoes have been created in the prior art that produce noise regardless to the surface upon which they are placed. In many such shoes, the force of the shoe hitting the ground is transferred to a hammer that strikes a noise producing element within the structure of the shoe. Such shoes are exemplified by U.S. Pat. No. 1,943,222 to Landi, entitled MUSICAL TAP DANCING SHOE and U.S. Pat. No. 2,753,220 to Miles, entitled NOISE MAKING TOY DEVICE.

It is the intention of the present invention to introduce a cap firing mechanism into the structure of a shoe. As such, when a child jumps and lands on the ground, that energy can be used to fire a cap, thereby producing a loud sound. Such a mechanism would be novel to a child and would promote play that involved the physical activity of running and jumping.

SUMMARY OF THE INVENTION

The present invention is a device and method for firing a cap contained within a row of caps. The device includes a base structure for retaining the row of caps so that one of the caps is set in a predetermined firing location. A hammer pin is provided that is movable with respect to the base structure and the cap held therein. The hammer pin is positioned adjacent to the cap in the predetermined firing position so that when the entire device is compressed the hammer pin strikes and fires the cap. The device is preferably compressed by locating the device either in or on the sole of a shoe. As a person stands on that shoe, the device will become compressed and the cap will fire.

The present invention device also preferably contains an advancement mechanism for automatically advancing a new cap into the firing position after a cap has been fired. In this manner, multiple caps can be fired simply by walking, running or jumping.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
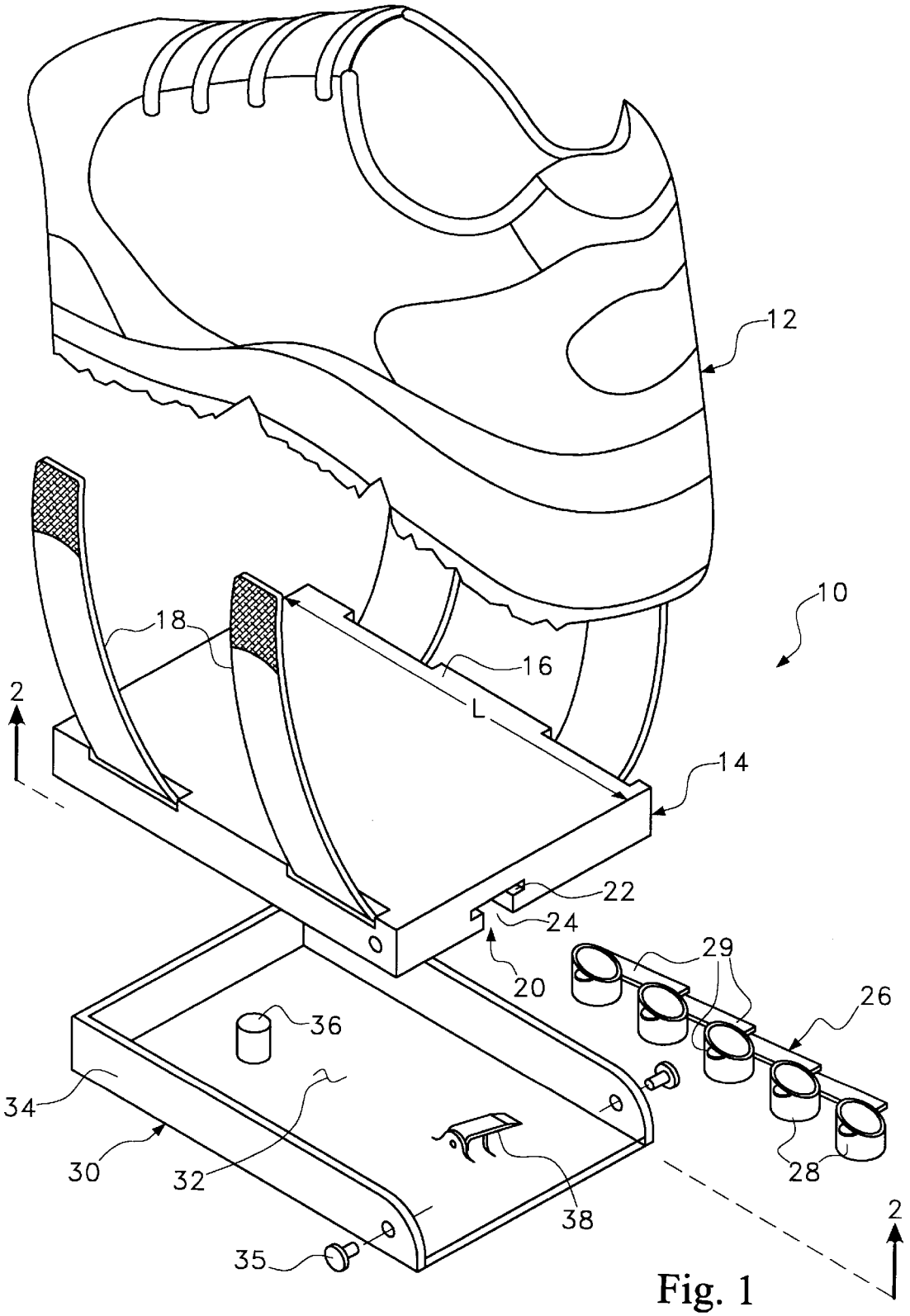
FIG. 1 is a perspective view of one preferred embodiment of the present invention cap firing device shown in conjunction with a shoe to illustrate the intended method of use for the present invention.

Referring to FIG. 1, an exemplary embodiment of a cap firing device 10 is shown in accordance with the present invention. The embodiment of the cap firing device 10 shown is an independent unit that attaches to the bottom of a shoe 12. As will be explained in conjunction with later embodiments, the cap firing device 10 can also be manufactured as part of the shoe structure itself.

In the shown embodiment, the cap firing device 10 has a base structure 14 with a generally planar top surface 16 that abuts against the sole of the shoe 12. The base structure 14 of the cap firing device 10 has a length L that is shorter that the sole of the shoe 12. As a result, the cap firing device 10 can be selectively placed at the heel region of the shoe, the ball region of the shoe or the toe region of the shoe. At least one strap 18 is provided for retaining the cap firing device 10 in abutment with the shoe 12. The straps 18 pass over the shoe 12 and join together using hook and loop fasteners, buckles or any other type of mechanical fastener. In an alternate embodiment, the straps 18 could simply be strings that are tied around the shoe 12.

A slot 20 is formed through the base structure 14 of the cap firing device 10. The slot 20 is T-shaped having a wide base region 22 and narrower neck region 24. The slot 20 is sized to receive a row of toy caps 26. The row of caps 26 is a common commercially available unit. The row of caps 26 is comprised of individual caps 28 joined together by flange elements 29 that retain the caps in a linear row. As the row of caps 26 passes into the slot 20, the flange elements 29 pass into the wide base region 22 of the slot 20 while the cylindrical structure of the caps 28 themselves passes through the neck region 24 of the slot 20. The slot 20 is deep enough to cover all of the caps 28 in the row of caps 26. As a result, when the row of caps 26 is placed into the cap firing device 10 and the cap firing device 10 is walked upon, the caps 28 are not crushed or otherwise damaged.

A hammer element 30 is joined to the base structure 14 of the cap firing device 10. The hammer element 30 covers the bottom surface of the base structure 14. The hammer element 30 shown has a planar base surface 32 that is rectangular in shape. A wall 34 extends upwardly from three of the four peripheral edges of the base surface 32. The three walls 34 therefore define an enclosed area with one open end. The area in between the three peripheral walls 34 is sized to receive the base structure 14 of the cap firing device 10, wherein the periphery of the base structure 14 will pass in between the three peripheral walls 34 of the hammer element 30. The hammer element 30 connects to the base structure 14 of the cap firing device 10 with pivots 35 at points near the open end of the hammer element 30.

A hammer pin 36 extends upwardly from the base surface 32 of the hammer element 30. As will later be explained, the hammer pin 36 is the element that strikes and fires the caps 28 held in the base structure 14 of the cap firing device 10. A ratchet pawl 38 also extends upwardly from the base surface 32 of the hammer element 30. The ratchet element 38 is pivotably connected to the base surface 32 of the hammer element 30. As will also be later explained, the ratchet pawl 38 is used as part of the mechanism that advances the row of caps 26 through the cap firing device 10.

Figure 2:
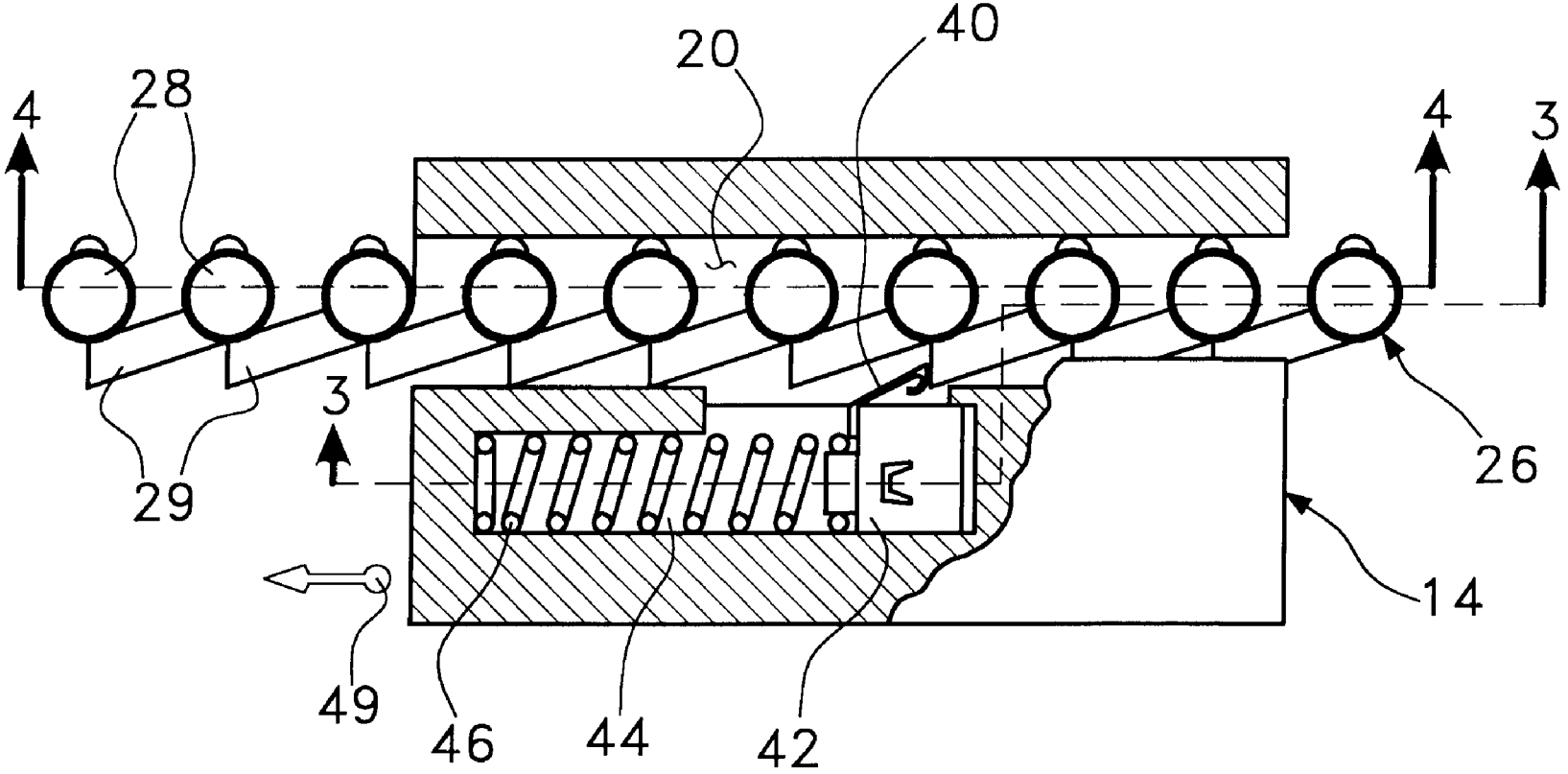
FIG. 2 a bottom view of base structure component of the cap firing device shown in FIG. 1.

Referring to FIG. 2, it can be seen that a cap advancement mechanism is located within the base structure 14 of the cap firing device 10. The cap advancement mechanism includes an advancement pawl 40 that engages the flange structure 29 that joins the caps 28 in the row of caps 26. As will be later explained in greater detail, the advancement pawl 40 is used to advance the caps 28 into a predetermined firing position and prevents the caps 28 from sliding backward in the wrong direction within the slot 20. The advancement pawl 40 is attached to a sliding block 42 that is situated within a channel 44 within the base structure 14 of the cap firing device. The sliding block 42 is biased into an advanced position by a spring 46. However, the sliding block 42 can move toward the spring 46 if engaged with a force greater than that provided by the bias of the spring 46.

Figure 3:
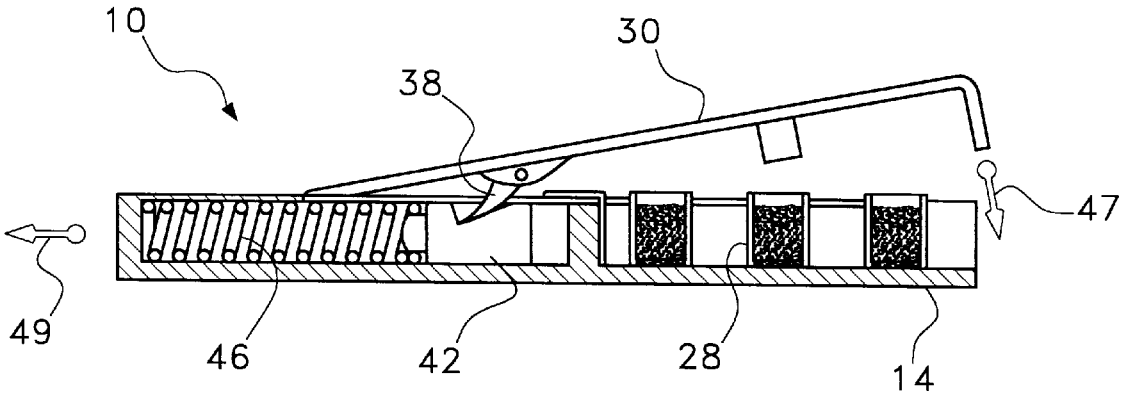
FIG. 3 is a cross-sectional view of the embodiment of the cap firing device shown in FIG. 2, viewed along section line 3—3.

Referring to FIG. 3, it can be seen that the ratchet pawl 38 on the hammer element 30 engages the sliding block 42 in the base structure 14 of the cap firing device 10 when the hammer element 30 is attached to the base structure 14. As the cap firing device 10 is stepped upon, the hammer element 30 is forced to close against the base structure 14 in the direction of arrow 47. This movement causes the rachet pawl 38 to push the sliding block 42 in the direction of arrow 49, thereby compressing the spring 46. Referring back to FIG. 2, it can be seen that as the sliding block 42 moves in the direction of arrow 49, the advancement pawl 40 also moves in the direction of arrow 49. As a result, the advancement pawl 40 passes across one of the caps 28 on the row of caps 26 and engages a flange element 29 extending from the next subsequent cap. As a person lifts his/her foot, the hammer element 30 (FIG. 3) moves away from the base structure 14 of the cap firing device 10 and the ratchet pawl 38 (FIG. 3) retracts relative to the sliding block 42. At this point, the spring 46 returns the sliding block 42 to the advanced position shown in FIG. 2. As the spring 46 moves the sliding block 42 forward, the advancement pawl 40 also moves forward. The advancement pawl 40 engages the row of caps 26 and moves the next subsequent cap into firing position.

Figure 4:
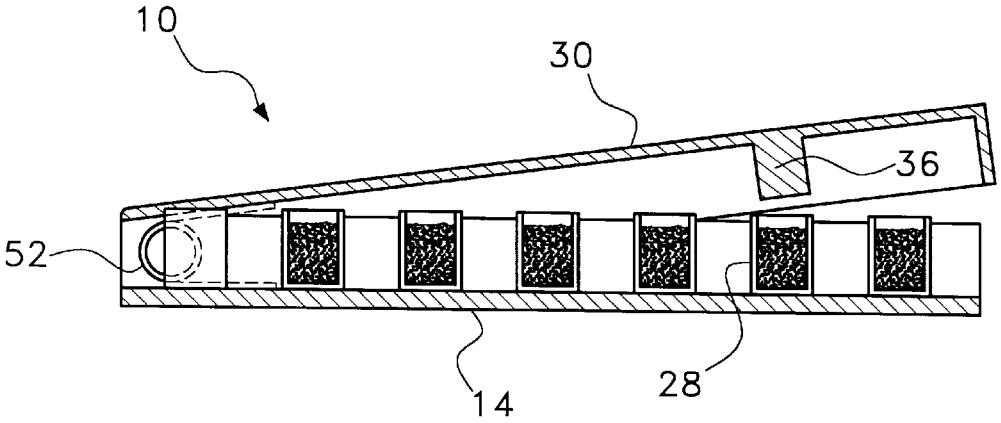
FIG. 4 is a cross-sectional view of the embodiment of the cap firing device shown in FIG. 2 viewed along section line 4—4.

Referring to FIG. 4, it can be seen that when a cap 28 is at the firing position, that cap 28 is directly aligned with the hammer pin 36 on the hammer element 30. Normally, the hammer element 30 is biased in an open, cocked position relative to the base structure 14 of the cap firing device 10 by torsion springs 52 located at the pivot points. When the hammer element 30 is in such an open cocked position, the hammer pin 36 does not contact the caps 28. However, as a person steps onto the cap firing device 10, the hammer element 30 is forced to close against the base structure 14 of the cap firing device 10. As the hammer element 30 closes against the base structure 14, the hammer pin 36 abuts against one of the caps 28. Once the force applied is great enough, the hammer pin 36 causes the cap 28 to explode and make the desired noise. As a person removes his/her weight from the cap firing device 10, the torsion springs 52 move the hammer element 30 way from the base structure 14. The next cap 28 is automatically advanced into the firing position in the manner previously described and the cap firing device 10 is again ready for use.

Figure 5:
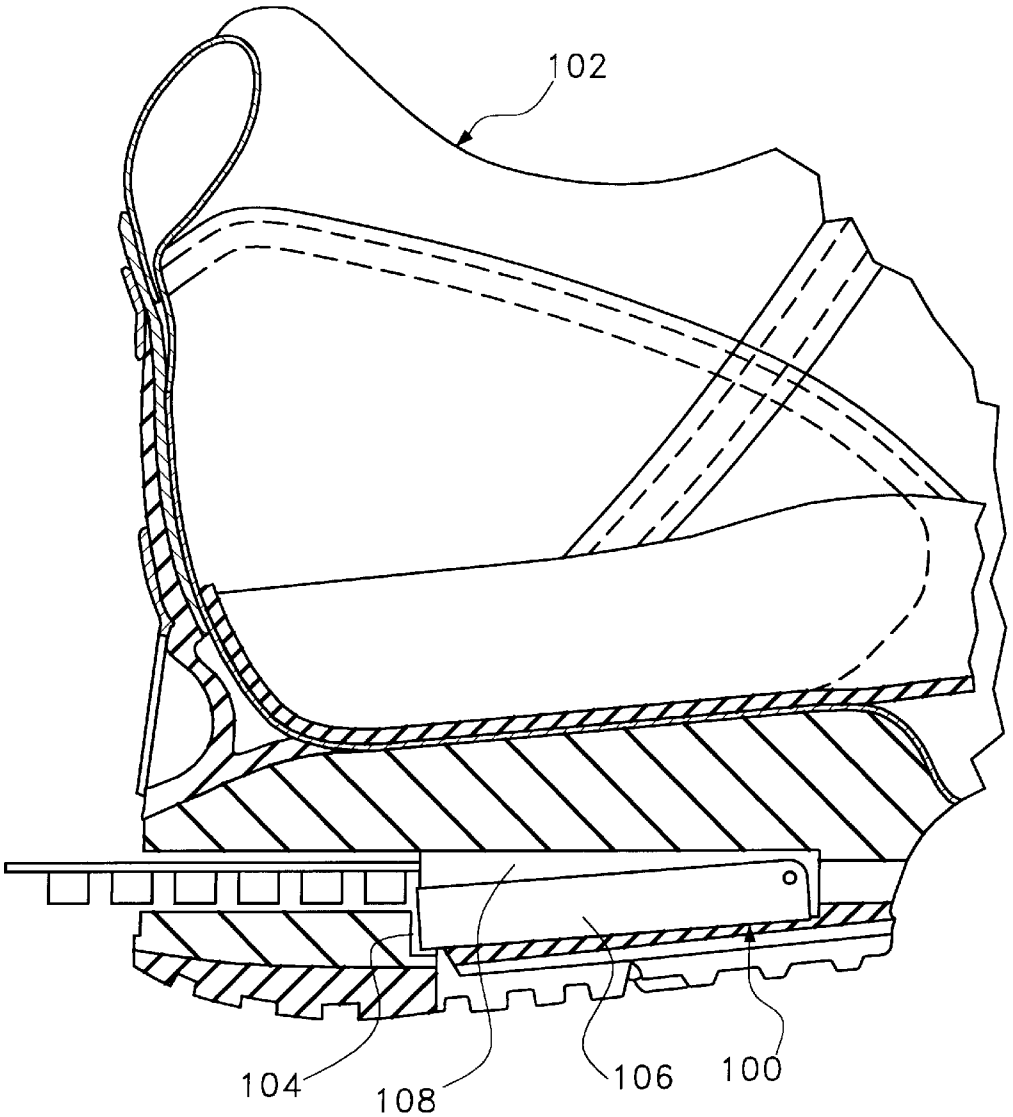
FIG. 5 is a selectively cross-sectional view of a sole of a shoe containing the present invention cap firing device.

In the previous embodiments, the cap firing device was shown as an independent unit that was attached to the exterior of a shoe. Referring to FIG. 5, an alternate embodiment is shown, wherein the present invention cap firing device 100 is manufactured directly into the structure of a shoe 102. The cap firing device 100 operates in the same manner as previously described, except the cap firing device 100 is now mounted in a chamber 104 within the sole of the shoe 102. The shoe 102 is preferably a sneaker or other show with a soft, flexible sole. As the shoe 102 is walked upon, the sole deforms under the weight of the person wearing that shoe 102. As the shoe sole deforms, the hammer element 106 is biased against the base structure 108 of the cap firing device 108 and the overall assembly operates in the manner previously described.

In the embodiments of FIG. 1 through FIG. 5, the firing pin was moved directly by deformations on the shoe caused by a person walking along the ground. It should be understood that other triggering mechanisms can also be used. For example, the firing pin/hammer element assembly of the previous embodiments can be free floating, wherein a change in acceleration can cause the firing pin to strike the cap. Depending upon the mass of the firing pin/hammer element assembly, the degree in change in acceleration needed to cause the cap to fire can be selectively controlled.

It will be understood that the embodiments of the present invention cap firing device illustrated and described above are merely exemplary and many variations and modifications can be made by using functionally equivalent components and/or alternate embodiments. All such variations and modifications are intended to be included within the scope of the invention as defined by the appended claims.

What is claimed is:

1. A device for firing a cap contained within a row of caps, comprising:

a base structure for retaining the row of caps so that one of the caps is set in a predetermined firing location;

a hammer pin that is movable with respect to said base structure between a cocked position and firing position, wherein said hammer pin contacts and fires a cap at said firing location when said hammer pin moves from said cocked position to said firing position;

a bias element for biasing said hammer pin in said cocked position;

an advancement mechanism contained within said base structure for advancing a new cap from said row of caps into said firing location each time said hammer pin is cycled between said firing position and said cocked position; and at least one strap attached to said base structure for attaching said base structure to a shoe.

2. The device according to claim 1, wherein said advancement mechanism includes a ratchet pawl that moves between a first position and a second position as said hammer pin moves between said cocked position and said firing position, respectively, said ratchet pawl engaging the row of caps and advancing said row of caps each time said ratchet pawl moves from said first position to said second position.

3. The device according to claim 2, further including a spring element that biases said rachet pawl into said second position.

4. The device according to claim 3, wherein said hammer pin is affixed to a larger hammer element that moves with said hammer pin as said hammer pin moves between said cocked position and said firing position.

5. The device according to claim 4, further including an element extending from said hammer element that moves said ratchet pawl from said second position back to said first position as said hammer pin moves from said cocked position to said firing position.

6. A device for firing a cap contained within a row of caps, comprising:

a base structure for retaining the row of caps so that one of the caps is set in a predetermined firing location;

a hammer pin that is movable with respect to said base structure between a cocked position and firing position, wherein said hammer pin contacts and fires a cap at said firing location when said hammer pin moves from said cocked position to said firing position;

a bias element for biasing said hammer pin in said cocked position;

an advancement mechanism contained within said base structure for advancing a new cap from said row of caps into said firing location each time said hammer pin is cycled between said firing position and said cocked position; and a shoe with a sole, wherein said base structure and said hammer pin are disposed within said sole, and wherein a person stepping on said shoe causes said hammer pin to move from said cocked position to said firing position.

7. The assembly according to claim 6, wherein said hammer pin strikes and fires the cap at said predetermined firing location when said sole is compressed between said shoe and another surface.

8. The device according to claim 6, wherein said advancement mechanism includes a ratchet pawl that moves between a first position and a second position as said hammer pin moves between said cocked position and said firing position, respectively, said ratchet pawl engaging the row of caps and advancing said row of caps each time said ratchet pawl moves from said first position to said second position.

9. The device according to claim 8, further including a spring element that biases said rachet pawl into said second position.

10. The device according to claim 8, further including an element extending from said hammer element that moves said ratchet pawl from said second position back to said first position as said hammer pin moves from said cocked position to said firing position.

11. The device according to claim 6, wherein said hammer pin is affixed to a larger hammer element that moves with said hammer pin as said hammer pin moves between said cocked position and said firing position.

* * * * *